US011250772B2

(12) United States Patent
Kong et al.

(10) Patent No.: US 11,250,772 B2
(45) Date of Patent: Feb. 15, 2022

(54) LIGHT-EMITTING ASSEMBLY, LIGHTING DEVICE, DISPLAY PANEL, AND DISPLAY DEVICE HAVING LIGHT-EMITTING DIODES WITH THERMISTOR CONTROLLED BRIGHTNESS

(71) Applicant: BOE TECHNOLOGY GROUP CO., LTD., Beijing (CN)

(72) Inventors: Chao Kong, Beijing (CN); Kening Zheng, Beijing (CN); Dong Chen, Beijing (CN); Mingyin Yu, Beijing (CN); Yinan Liang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 730 days.

(21) Appl. No.: 16/067,598

(22) PCT Filed: Dec. 15, 2017

(86) PCT No.: PCT/CN2017/116512
§ 371 (c)(1),
(2) Date: Jun. 30, 2018

(87) PCT Pub. No.: WO2018/205614
PCT Pub. Date: Nov. 15, 2018

(65) Prior Publication Data

US 2021/0166622 A1 Jun. 3, 2021

(30) Foreign Application Priority Data

May 12, 2017 (CN) ..... 201710333863.4

(51) Int. Cl.
*G09G 3/3258* (2016.01)
*G09G 3/3225* (2016.01)

(52) U.S. Cl.
CPC ... *G09G 3/3225* (2013.01); *G09G 2320/0233* (2013.01); *G09G 2320/041* (2013.01)

(58) Field of Classification Search
CPC ..... G09G 3/3258; G09G 3/3225; G09G 2320/0295; G09G 2320/04;
(Continued)

(56) References Cited

U.S. PATENT DOCUMENTS

2006/0082523 A1* 4/2006 Guo ..... G09G 3/3233 345/76
2006/0160255 A1 7/2006 Chang
(Continued)

FOREIGN PATENT DOCUMENTS

CN 103177692 A 6/2013
CN 104103231 A 10/2014

OTHER PUBLICATIONS

International Search Report and Written Opinion dated Mar. 16, 2018 in PCT/CN2017/116512.
(Continued)

*Primary Examiner* — Dennis P Joseph
(74) *Attorney, Agent, or Firm* — Syncoda LLC; Feng Ma

(57) ABSTRACT

A light-emitting assembly contains a light-emitting diode and a driving circuit configured to provide a driving current for driving the light-emitting diode to emit a light. The driving circuit comprises a thermistor, which is coupled to the light-emitting diode and configured to have an electrical resistance thereof altering with a change of a temperature of the light-emitting assembly to thereby adjust an intensity of the driving current. The thermistor can be a metal thermistor, a negative-temperature coefficient thermistor, a critical-temperature thermistor, or a positive-temperature coefficient thermistor. The light-emitting assembly can automatically adjust a brightness of the light emitted by the light-emitting
(Continued)

diode to be within an expected range, causing an improved working life and reliability. The light-emitting assembly can be employed in a lighting device or a display panel.

20 Claims, 5 Drawing Sheets

(58) Field of Classification Search
CPC ..... G09G 2320/041; G09G 2320/043; G09G 2320/045; G09G 2320/046; G09G 2320/0666
See application file for complete search history.

(56) References Cited

U.S. PATENT DOCUMENTS

| | | | | |
|---|---|---|---|---|
| 2011/0199401 | A1* | 8/2011 | Fujiwara ..... | H05B 45/10 345/690 |
| 2014/0292739 | A1 | 10/2014 | Kim et al. | |
| 2018/0006097 | A1 | 1/2018 | Xiong et al. | |

OTHER PUBLICATIONS

1st Office Action dated Apr. 23, 2019 in CN201710333863.4.
The Second CN Office Action in Application No. 201710333863.4, dated Jan. 2, 2020.

* cited by examiner

LIGHT-EMITTING ASSEMBLY, LIGHTING DEVICE, DISPLAY PANEL, AND DISPLAY DEVICE HAVING LIGHT-EMITTING DIODES WITH THERMISTOR CONTROLLED BRIGHTNESS

CROSS-REFERENCES TO RELATED APPLICATION

The present application claims priority to Chinese Patent Application No. 201710333863.4 filed on May 12, 2017, the disclosure of which is hereby incorporated by reference in its entirety.

TECHNICAL FIELD

The present disclosure relates generally to the field of display technologies, and more specifically to a light-emitting assembly, a lighting device and a display panel comprising the light-emitting assembly, and a display device comprising the display panel.

BACKGROUND

Light-emitting diodes (LED) have been widely used in a variety of lighting devices and display devices. Current light-emitting diode (LED) display panels in the market include organic light-emitting diode (OLED) display devices and micro LED display devices.

SUMMARY

In a first aspect, the present disclosure provides a light-emitting assembly. The light-emitting assembly comprise a light-emitting diode and a driving circuit.

The driving circuit is configured to provide a driving current for driving the light-emitting diode to emit a light. The driving circuit comprises a thermistor. The thermistor is coupled to the light-emitting diode and is configured to have an electrical resistance thereof altering with a change of a temperature of the light-emitting assembly to thereby adjust an intensity of the driving current.

Herein, the thermistor can comprise at least one of a metal thermistor, a negative-temperature coefficient thermistor, a critical-temperature thermistor, or a positive-temperature coefficient thermistor.

According to some embodiments of the light-emitting assembly, the thermistor comprises a metal thermistor or a positive-temperature coefficient thermistor, and the thermistor is coupled to the light-emitting diode in series.

In embodiments of the light-emitting assembly where the thermistor comprises a metal thermistor, the metal thermistor can include at least one of a copper thermistor, a platinum thermistor, or a nickel thermistor.

In embodiments of the light-emitting assembly where the thermistor comprises a metal thermistor or a positive-temperature coefficient thermistor, the driving circuit can further include a driving transistor. It can be configured such that a first electrode of the driving transistor is coupled in series to the thermistor, and a second electrode of the driving transistor is coupled in series to the light-emitting diode.

According to some other embodiments of the light-emitting assembly, the thermistor comprises a negative-temperature coefficient thermistor, and the thermistor is coupled to the light-emitting diode in parallel.

In any of the embodiments of the light-emitting assembly, the light-emitting diode comprises at least one of an organic light-emitting diode or an inorganic light-emitting diode.

In a second aspect, the present disclosure further provides a lighting device. The lighting device comprises a light-emitting assembly according to any one of the embodiments as described above.

In a third aspect, a display panel is further disclosed. The display panel includes a plurality of pixel units, and each of the plurality of pixel units can comprise at least one light-emitting assembly. Each of the at least one light-emitting assembly can be based on any one the embodiments as described above.

In each of the plurality of pixel units in the display panel, the light-emitting diode in each of the at least one light-emitting assembly can be configured to emit a light of a different primary color, and lights from the light-emitting diode from each of the at least one light-emitting assembly can be configured, once mixed with one another, to give rise to a white light.

In each of the plurality of pixel units in the display panel as described above, the thermistor in each of the at least one light-emitting assembly can be configured to adjust a brightness of the light emitted from the light-emitting diode such that the lights from the light-emitting diode from each of the at least one light-emitting assembly can give rise to a white light without a substantial deviation.

According to some embodiments of the display panel, the thermistor comprises at least one of a metal thermistor or a positive-temperature coefficient thermistor, and the thermistor is coupled to the light-emitting diode in series.

In each of the plurality of pixel units in the display panel as described above, each of the at least one light-emitting assembly can further comprise a driving transistor, and the thermistor can comprise a metal thermistor. It can be configured such that a first electrode of the driving transistor is coupled in series to the thermistor, and a second electrode of the driving transistor is coupled in series to the light-emitting diode.

Herein, optionally, the first electrode of the driving transistor is a source electrode of the driving transistor, and the second electrode of the driving transistor is a drain electrode of the driving transistor.

In these above embodiments of the display panel where the thermistor comprises at least one of a metal thermistor or a positive-temperature coefficient thermistor, each of the plurality of pixel units can comprise a first light-emitting assembly, a second light-emitting assembly, and a third light-emitting assembly.

Herein, the first light-emitting assembly can include a first thermistor, a first driving transistor, and a red light-emitting diode, the second light-emitting assembly can include a second thermistor, a second driving transistor, and a green light-emitting diode; and the third light-emitting assembly can include a third thermistor, a third driving transistor, and a blue light-emitting diode. It can be configured such that an electrical resistance of the first thermistor is higher than an electrical resistance of the second thermistor, and the electrical resistance of the second thermistor is higher than an electrical resistance of the third thermistor.

According to some other embodiments of the display panel, the thermistor comprises a negative-temperature coefficient thermistor, and the thermistor is coupled to the light-emitting diode in parallel.

In each of the plurality of pixel units in the display panel as described above, each of the at least one light-emitting assembly can further comprise a driving transistor, and it can be configured such that two terminals of the thermistor are respectively coupled to an anode and a cathode of the light-emitting diode, and one electrode of the driving transistor is coupled in series to the light-emitting diode.

Herein, the one electrode of the driving transistor can be a drain electrode of the driving transistor.

In these above embodiments of the display panel where the thermistor comprises a negative-temperature coefficient thermistor, each of the plurality of pixel units comprises a first light-emitting assembly, a second light-emitting assembly, and a third light-emitting assembly.

Herein, the first light-emitting assembly can include a first thermistor, a first driving transistor, and a red light-emitting diode, the second light-emitting assembly can include a second thermistor, a second driving transistor, and a green light-emitting diode, and the third light-emitting assembly can include a third thermistor, a third driving transistor, and a blue light-emitting diode. It can be configured such that an electrical resistance of the first thermistor is lower than an electrical resistance of the second thermistor, and the electrical resistance of the second thermistor is lower than an electrical resistance of the third thermistor.

In a fourth aspect, a display device is further provided. The display device includes a display panel according to any one of the embodiments as described above.

Other embodiments may become apparent in view of the following descriptions and the attached drawings.

BRIEF DESCRIPTION OF THE DRAWINGS

To more clearly illustrate some of the embodiments as described above, the following is a brief description of the drawing(s). It is noted that the drawing(s) in the following description are only illustrative of some, but not all, embodiments of the present disclosure, and thus shall not be construed as a limitation to the scope of the disclosure. For those of ordinary skill in the art, other drawing(s) of other embodiments can become apparent based on these drawings.

DETAILED DESCRIPTION

Figure 1:
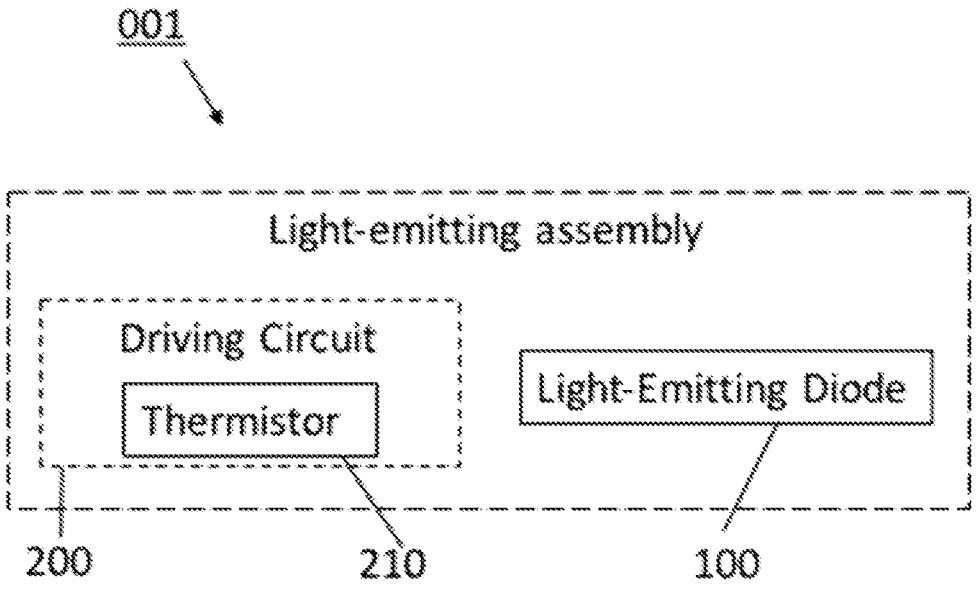
FIG. 1 illustrates a light-emitting assembly according to some embodiments of the disclosure.

In the following, with reference to the drawing(s) of various embodiments disclosed herein, the technical solutions of the embodiments of the disclosure will be described in a clear and fully understandable way.

It is obvious that the described embodiments are merely a portion but not all of the embodiments of the disclosure. Based on the described embodiments of the disclosure, those ordinarily skilled in the art can obtain other embodiment(s), which come(s) within the scope sought for protection by the disclosure.

Typically, with a continuous use of a light-emitting diode, the light-emitting diode becomes hot. It is a characteristic for a light-emitting diode that the higher the temperature of the environment, the brighter the light emitted by the light-emitting diode.

Yet if the temperature increases to a certain level, the brightness of the light-emitting diode can go beyond an acceptable range, which can negatively influence the working life of the light-emitting diode.

There is another issue related to the LED display devices, which typically include a red light-emitting diode, a green light-emitting diode, and a blue light-emitting diode in each pixel unit. It has been found that the degrees of changes in the brightness of the light-emitting diodes that accompany the changes in the temperatures are different for different color light-emitting diodes.

Specifically, at a relatively high temperature, the red light-emitting diode exhibits a largest degree of increase in the brightness of the red light it emits, followed by the green light-emitting diode, which exhibits an intermediate degree of increase in the brightness of the green light it emits, and the blue light-emitting diode exhibits a smallest degree of increase in the brightness of the blue light it emits.

The unbalanced changes of brightness among the three different light-emitting diodes in each pixel unit over a time period of use of the LED display panel may result in a deviation of the supposedly white color in each pixel unit obtained by the mixture of the three primary colors, which in turn can cause an alteration of the color temperature, leading to a reduced display quality of the display panel.

In light of the above issues associated with current lighting devices and display devices comprising light-emitting diodes, the disclosure provides a light-emitting assembly, a lighting device incorporating the light-emitting assembly, and a display panel incorporating the light-emitting assembly.

In one aspect, the present disclosure provides a light-emitting assembly.

FIG. 1 illustrates a light-emitting assembly according to some embodiments of the disclosure. As shown in FIG. 1, the light-emitting assembly 001 comprises a light-emitting diode 100 and a driving circuit 200 that drives the light-emitting diode to emit a light. The light-emitting assembly 001 further comprises a thermistor 210, arranged in the driving circuit 200.

The thermistor 210 is configured such that an electrical resistance thereof alters as a temperature changes, which in turn can alter an intensity of a current that drives the light-emitting diode 100 to emit a light.

With an increasing working time of the light-emitting assembly 001, a temperature of the light-emitting assembly 001 increases, which causes an alteration in the electrical resistance of the thermistor 110, in turn resulting in a change in the intensity of the current that is outputted from the driving circuit 200 to the light-emitting diode 100.

Because an alteration of the intensity of the current flowing through the light emitting diode 100 can accordingly alter the brightness of the light-emitting diode 100, by arranging a thermistor 210 in the driving circuit 200 that can alter the intensity of the current that drives the light-emitting diode 100 to emit a light, it is possible to control the temperature-dependent alteration of brightness of the light-emitting diode, an issue that has been frequently associated with current LED lighting devices and LED display devices.

On the other hand, as the temperature of the light-emitting assembly 001 decreases, the electrical resistance of the thermistor 210 changes accordingly, the intensity of the current outputted by the driving circuit 200 to the light-emitting diode 100 can also change, and the brightness of the light-emitting diode 100 can thereby be adjusted.

As such, the light-emitting assembly 001 disclosed herein can automatically adjust a brightness of an light-emitting diode 100 disposed therein when the light-emitting diode 100 emits lights, thereby the brightness of the light-emitting diode 100 in the light-emitting assembly 001 can be controlled to be within an expected range, which in turn can cause an improved working life and an improved reliability of the light-emitting diode 100.

Herein the thermistor is defined as an electrical component, whose electrical resistance changes as the temperature changes. A thermistor can be any of the following four types:

(1) a metal thermistor, whose electrical resistance increases linearly as the temperature increases, with a temperature coefficient of resistance of, for example, around $+0.004\ K^{-1}$;

(2) a negative-temperature coefficient thermistor, such as one with a temperature coefficient of resistance of around $-0.02\ K^{-1}$ to $-0.006\ K^{-1}$ at a room temperature, whose electrical resistance decreases exponentially as the temperature increases;

(3) a critical-temperature thermistor, whose electrical resistance decreases sharply, with, for example, a change of 2-4 orders of magnitude, as the temperature increases when the temperature is within a certain range; and (4) a positive-temperature coefficient thermistor, which can typically include a gradual positive-temperature coefficient thermistor and a switch-type positive-temperature coefficient thermistor.

Figure 2A:
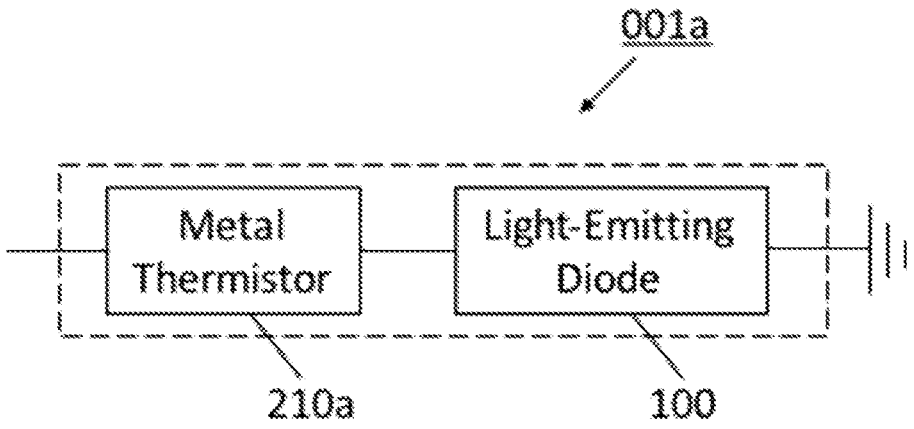
FIG. 2A illustrates a light-emitting assembly having a metal thermistor according to a first embodiment of the disclosure.

According to a first embodiment of the light-emitting assembly 001*a*, the thermistor 210 can comprise a metal thermistor 210*a*, which is connected in series with the light-emitting diode 100, as shown in FIG. 2A.

Specifically, the electrical resistance-temperature relationship of the metal thermistor can be shown in formula (1):

$$R_T=R_0(1+\alpha T) \quad (1)$$

where $R_T$ is the electrical resistance of the metal thermistor at temperature T; $\alpha$ is the temperature coefficient of the composition for the metal thermistor ($\alpha>0$); and $R_0$ is the electrical resistance at a temperature of 0° C.

As the temperature of the light-emitting assembly 001*a* increases, the electrical resistance of the metal thermistor 210*a* increases, and accordingly, due to the partial sharing of the voltage by the metal thermistor 210*a* in the driving circuit, the voltage on two terminals of the light-emitting diode 100 decreases.

Because of the decrease of the voltage at the two terminals of the light-emitting diode 100, the current that flows through the light-emitting diode 100 decreases, and the brightness of the light-emitting diode 100 is thus adjusted to be within an expected range and is prevented from increasing to an unacceptable level.

As such, the working life for the light-emitting diode 100 in the light-emitting assembly 001*a* can be improved, therefore leading to an improved reliability of the light-emitting diode.

It is noted that in this present disclosure, there are no limitations to the specific structure of the light-emitting diode. For example, the light-emitting diode can be an organic light-emitting diode (OLED), an inorganic light-emitting diode (LED), or can be another type of a thin film light-emitting component.

It is further noted that there are no limitations to the material of the metal thermistor. The metal thermistor can comprise any one, or a combination, of a copper thermistor, a platinum thermistor, or a nickel thermistor.

According to some specific embodiments, the thermistor comprises a nickel thermistor, which has advantages such as low lost, corrosion resistance, high sensitivity, and high reproducibility.

It is noted that besides the first embodiment of the light-emitting assembly 001*a* as shown in FIG. 2A, where a metal thermistor 210*a* is connected in series with a light-emitting diode 100 to adjust the current driving the light-emitting diode 100, a positive-temperature coefficient thermistor, as described above as the fourth type of the thermistor, can also be employed.

Figure 2B:
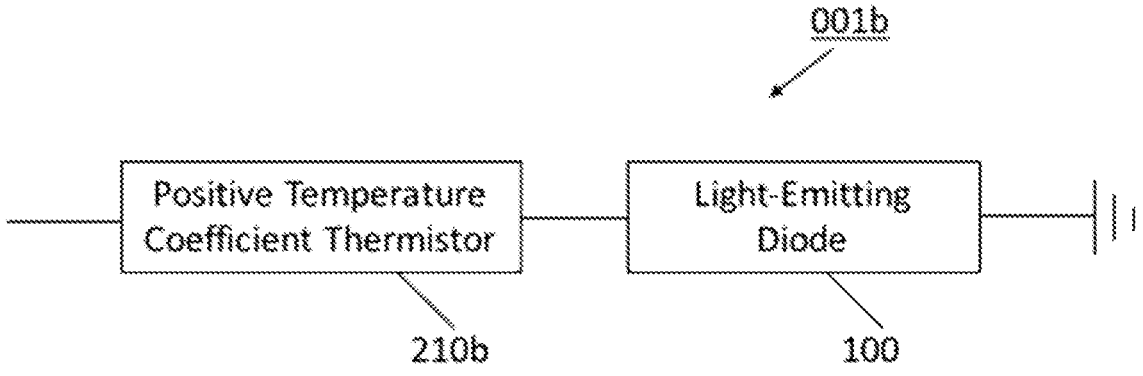
FIG. 2B illustrates a light-emitting assembly having a positive-temperature coefficient thermistor according to a second embodiment of the disclosure.

As such, according a second embodiment of the light-emitting assembly 001*b* as shown in FIG. 2B, a positive-temperature coefficient thermistor 210*b* is connected in series with a light-emitting diode 100.

Specifically, the electrical resistance-temperature relationship of the positive-temperature coefficient thermistor 210*b* can also be shown in formula (1):

$$R_T=R_0(1+\alpha T) \quad (1)$$

where $R_T$ is the electrical resistance of the positive-temperature coefficient thermistor at temperature T; $\alpha$ is the temperature coefficient of the composition for the positive-temperature coefficient thermistor ($\alpha>0$); and $R_0$ is the electrical resistance at a temperature of 0° C.

In this second embodiment of the light-emitting assembly 001*b*, the positive-temperature coefficient thermistor 210*b* works in a substantially similar manner as the metal thermistor 210*a* in the first embodiment of the light-emitting assembly 001*a*.

Figure 2C:
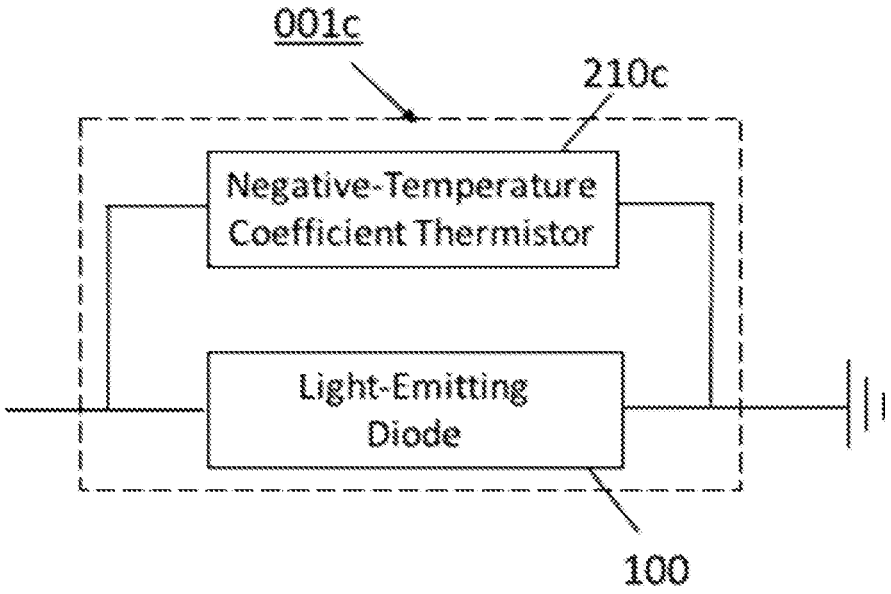
FIG. 2C illustrates a light-emitting assembly having a negative-temperature coefficient thermistor according to a third embodiment of the disclosure.

According to a third embodiment of the light-emitting assembly 001*c*, the thermistor comprises a negative-temperature coefficient thermistor 210*c*, which is connected in parallel with the light-emitting diode 100, as illustrated in FIG. 2C.

Specifically, in this third embodiment of the light-emitting assembly 001*c*, one terminal of the negative-temperature coefficient thermistor 201*c* is electrically coupled to an anode of the light-emitting diode 100, and another terminal of the negative-temperature coefficient thermistor is electrically connected to a cathode of the light emitting diode 100.

Specifically, the electrical resistance-temperature relationship of the negative-temperature coefficient thermistor 210*b* can also be shown in formula (1):

$$R_T=R_0(1+\alpha T) \quad (1)$$

where $R_T$ is the electrical resistance of the negative-temperature coefficient thermistor at temperature T; $\alpha$ is the temperature coefficient of the composition for the negative-temperature coefficient thermistor ($\alpha<0$); and $R_0$ is the electrical resistance at a temperature of 0° C.

As the temperature of the light-emitting assembly 001*c* increases, the electrical resistance of the negative-temperature coefficient thermistor 210*c* decreases. Accordingly, due to the parallel connection of the negative-temperature coefficient thermistor 210*c*, the current on the two terminals of the light-emitting diode 100 decreases, which controls that the brightness of the light-emitting diode 100 to be within an expected range and is prevented from increasing to an unacceptable level.

As such, the working life for the light-emitting diode 100 in the light-emitting assembly 001*c* can be improved, therefore leading to an improved reliability of the light-emitting diode 100.

The above embodiments of the light-emitting assembly can be applied in different fields.

In one example, the light-emitting assembly can be utilized in a lighting device, such as a desk lamp. Because the working life of the light-emitting assembly disclosed herein is relatively long, the lighting device employing the light-emitting assembly disclosed herein also has a relatively long working life.

In another example, the light-emitting assembly can also be employed in a display device. Due to the relatively long working life of the light-emitting assembly employed in the display device, the display device can also have a prolonged working life.

In another aspect, the present disclosure further provides a display panel.

The display panel comprises a plurality of pixel units. At least one light-emitting assembly is configured in each pixel unit. Each of the at least one light-emitting assembly can be a light-emitting assembly according to any one of the embodiments as described above.

As the working time of the display panel comprising the display panel increases, the temperature of the display panel also increases. Because each of the at least one light-emitting assembly in each pixel unit is provided with a thermistor, the brightness of the light-emitting diode in each light-emitting assembly in each pixel unit can be controlled to be within the expected range. As such, the displaying quality of the display panel can be improved, the reliability of the display panel can be improved, and the working life of the display panel can also be prolonged.

In a color display panel, each of the plurality of pixel units can comprise more than one different light-emitting diodes, each configured to emit a light of a different primary color, which together can form a white color after mixing at an appropriate ratio.

Figure 3A:
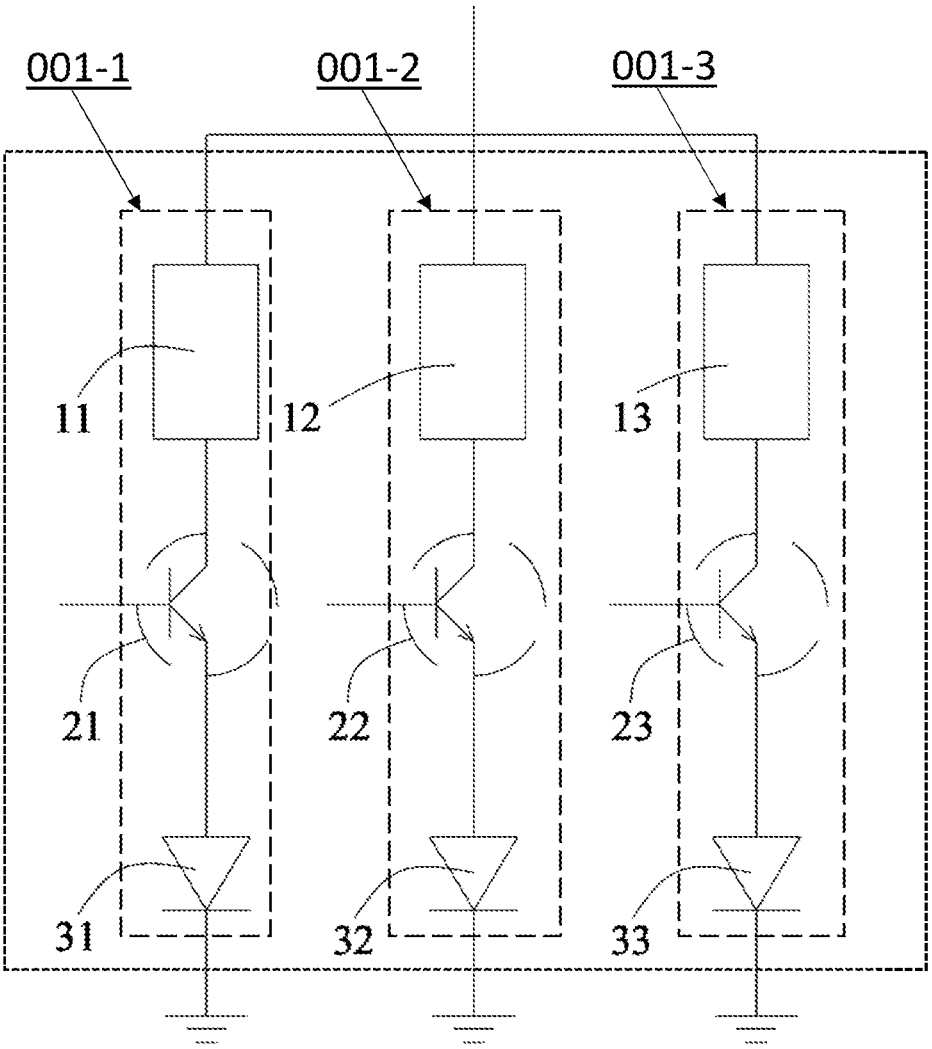
FIG. 3A illustrates a circuit diagram of a display panel according to a first embodiments of the disclosure.

In a first embodiment as illustrated in FIG. 3A, the display panel can be in a RGB mode, and comprises in each pixel unit, a red light-emitting diode 31, a green light-emitting diode 32, and a blue light-emitting diode 33, which are configured to respectively emit a red light, a green light, and a blue light.

As shown in FIG. 3A, the red light-emitting diode 31, the green light-emitting diode 32, and the blue light-emitting diode 33 are respectively included in a first light-emitting assembly 001-1, a second light-emitting assembly 001-2, and a third light-emitting assembly 001-3 in each pixel unit of the display panel.

The first light-emitting assembly 001-1 further includes a first thermistor 11 and a first driving transistor 21. In the first light-emitting assembly 001-1, the first thermistor 11, the first driving transistor 21, and the red light-emitting diode 31 are connected such that a first electrode of the first driving transistor 21 is coupled in series to the first thermistor 11, and a second electrode of the first driving transistor 21 is coupled in series to the red light-emitting diode 31. Herein, optionally, the first electrode of the first driving transistor 21 can be a source electrode, the second electrode of the first driving transistor 21 can be a drain electrode, and the drain electrode of the first driving transistor 21 can be coupled to an anode of the red light-emitting diode 31.

The second light-emitting assembly 001-2 further includes a second thermistor 12 and a second driving transistor 22. In the second light-emitting assembly 001-2, the second thermistor 12, the second driving transistor 22, and the green light-emitting diode 32 are connected such that a first electrode of the second driving transistor 22 is coupled in series to the second thermistor 12, and a second electrode of the second driving transistor 22 is coupled in series to the green light-emitting diode 32. Herein, optionally, the first electrode of the second driving transistor 22 can be a source electrode, the second electrode of the second driving transistor 22 can be a drain electrode, and the drain electrode of the second driving transistor 22 can be coupled to an anode of the green light-emitting diode 32.

The third light-emitting assembly 001-3 further includes a third thermistor 13 and a third driving transistor 23. In the third light-emitting assembly 001-3, the third thermistor 13, the third driving transistor 23, and the blue light-emitting diode 33 are connected such that a first electrode of the third driving transistor 23 is coupled in series to the third thermistor 13, and a second electrode of the third driving transistor 23 is coupled in series to the green light-emitting diode 33. Herein, optionally, the first electrode of the third driving transistor 23 can be a source electrode, the second electrode of the third driving transistor 23 can be a drain electrode, and the drain electrode of the third driving transistor 23 can be coupled to an anode of the blue light-emitting diode 33.

In order for the light-emitting diodes of different colors in each pixel unit (i.e. the red light-emitting diode 31, the green light-emitting diode 32, and the blue light-emitting diode 33) to respectively emit the light of a different color (i.e. a red light, a green light, and a blue light) in an appropriate ratio to thereby obtain a balanced white light after these lights of difference colors are mixed together, the first thermistor 11, the second thermistor 12, and the third thermistor 13 are each configured to comprise a metal thermistor, and together are configured to satisfy the following relationship:

$$R1>R2>R3;$$

where R1 is an electrical resistance of the first thermistor 11, R2 an electrical resistance of the second thermistor 12, and R3 an electrical resistance of the third thermistor 13.

It is noted that the above configuration as illustrated in FIG. 3A can also be applied to a positive-temperature coefficient thermistor.

Figure 3B:
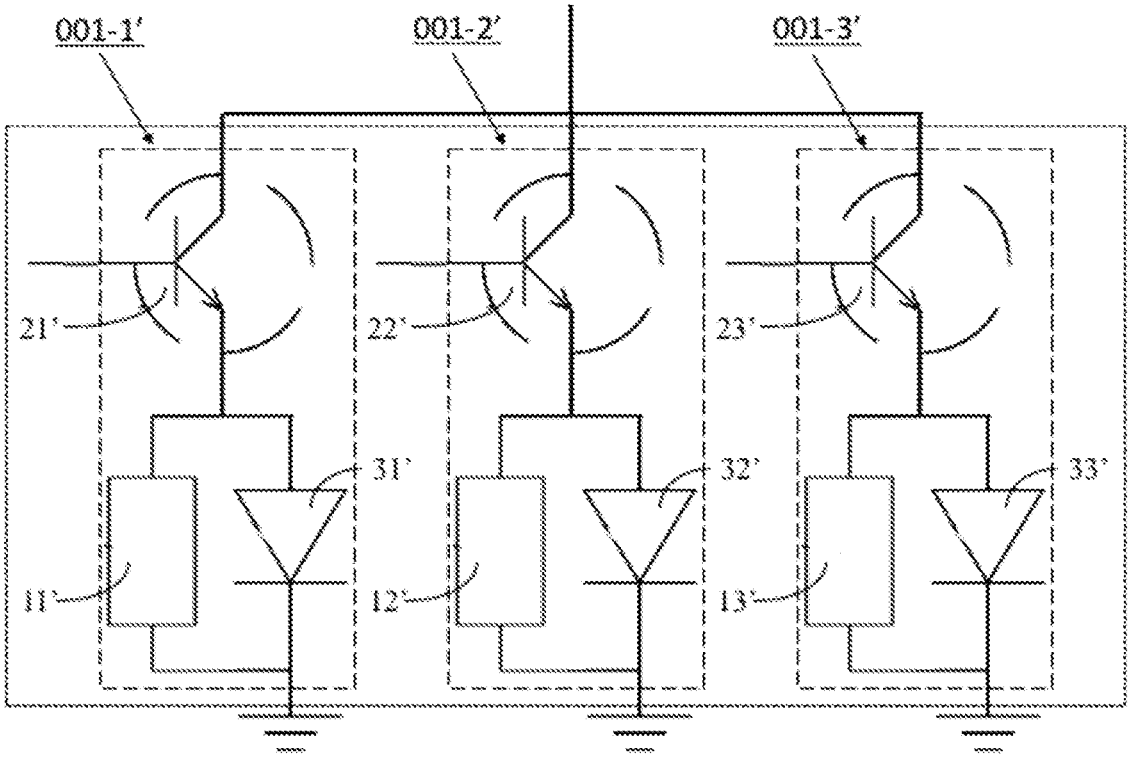
FIG. 3B illustrates a circuit diagram of a display panel according to a second embodiments of the disclosure.

In a second embodiment as illustrated in FIG. 3B, the display panel is also in a RGB mode, and comprises in each pixel unit, a red light-emitting diode 31', a green light-emitting diode 32', and a blue light-emitting diode 33', which are configured to respectively emit a red light, a green light, and a blue light.

As shown in FIG. 3B, the red light-emitting diode 31', the green light-emitting diode 32', and the blue light-emitting diode 33' are respectively included in a first light-emitting assembly 001-1', a second light-emitting assembly 001-2', and a third light-emitting assembly 001-3' in each pixel unit of the display panel.

The first light-emitting assembly 001-1' further includes a first thermistor 11' and a first driving transistor 21'. In the first light-emitting assembly 001-1', the first thermistor 11', the first driving transistor 21', and the red light-emitting diode 31' are connected such that the red light-emitting diode 31' is connected in parallel with the first thermistor 11', which together are coupled in series to one electrode of the first driving transistor 21'. Herein, optionally, the anode of the red light-emitting diode 31' is coupled to a drain electrode of the first driving transistor 21'.

The second light-emitting assembly 001-2' further includes a second thermistor 12' and a second driving transistor 22'. In the second light-emitting assembly 001-2', the second thermistor 12', the second driving transistor 22', and the green light-emitting diode 32' are connected such that the green light-emitting diode 32' is connected in parallel with the second thermistor 12', which together are connected in series to one electrode of the second driving transistor 22'. Herein, optionally, the anode of the green light-emitting diode 32' is coupled to a drain electrode of the second driving transistor 22'.

The third light-emitting assembly 001-3' further includes a third thermistor 13' and a third driving transistor 23'. In the third light-emitting assembly 001-3', the third thermistor 13', the third driving transistor 23', and the blue light-emitting diode 33' are connected such that the blue light-emitting diode 33' is connected in parallel with the third thermistor 13', which together are connected in series to one electrode of the third driving transistor 23'. Herein, optionally, the anode of the blue light-emitting diode 33' is coupled to a drain electrode of the third driving transistor 23'.

In order for the light-emitting diodes of different colors in each pixel unit (i.e. the red light-emitting diode 31', the green light-emitting diode 32', and the blue light-emitting diode 33') to respectively emit the light of a different color (i.e. a red light, a green light, and a blue light) in an appropriate ratio to thereby obtain a balanced white light after these lights of difference colors are mixed together, the first thermistor 11', the second thermistor 12', and the third thermistor 13' are each configured to comprise a negative-temperature coefficient thermistor, and together are configured to satisfy the following relationship:

$$R1<R2<R3;$$

where R1 is an electrical resistance of the first thermistor 11', R2 an electrical resistance of the second thermistor 12', and R3 an electrical resistance of the third thermistor 13'.

In yet another aspect, the present disclosure provides a display device, the display device comprises a display panel according to any of the embodiments as described above.

All references cited in the present disclosure are incorporated by reference in their entirety. Although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the exemplary embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

The invention claimed is:

1. A light-emitting assembly, comprising:

a plurality of light-emitting diodes; and a plurality of driving circuits corresponding respectively to the plurality of light-emitting diodes and each configured to provide a driving current for driving each of the plurality of light-emitting diodes to emit a light;

wherein:

each of the plurality of driving circuits comprises a thermistor, coupled to a corresponding light-emitting diode and configured to have an electrical resistance thereof altering with a change of a temperature of the light-emitting assembly to thereby adjust an intensity of the driving current;

there is a one-to-one ratio between the plurality of thermistors and the plurality of light-emitting diodes, each of the plurality of light-emitting diodes being associated with a particular thermistor;

the electrical resistance has a relationship with the temperature as $R_T=R_0(1+\alpha T)$, where $R_T$ is an electrical resistance of the thermistor at a temperature T; $\alpha$ is a temperature coefficient of a composition of the thermistor, wherein $\alpha>0$, and $R_0$ is an electrical resistance at a temperature of 0° C.; and the plurality of light-emitting diodes include red, green, and blue light-emitting diodes respectively associated with first, second, and third thermistors with respective electrical resistance R1>R2>R3, to thereby realize automatic adjusting of the driving current.

2. The light-emitting assembly of claim 1, wherein each thermistor comprises at least one of a metal thermistor or a positive-temperature coefficient thermistor.

3. The light-emitting assembly of claim 2, wherein:

each thermistor comprises a negative-temperature coefficient thermistor; and each thermistor is coupled to its associated light-emitting diode in parallel.

4. The light-emitting assembly of claim 2, wherein:

each thermistor is coupled to its associated light-emitting diode in series.

5. The light-emitting assembly of claim 4, wherein each thermistor comprises a metal thermistor, wherein the metal thermistor comprises at least one of a copper thermistor, a platinum thermistor, or a nickel thermistor.

6. The light-emitting assembly of claim 5, wherein each thermistor comprises a nickel thermistor.

7. The light-emitting assembly of claim 4, wherein each driving circuit further comprises a driving transistor, wherein:

a first electrode of the driving transistor is coupled in series to the thermistor; and a second electrode of the driving transistor is coupled in series to the light-emitting diode.

8. The light-emitting assembly of claim 1, wherein each light-emitting diode comprises at least one of an organic light-emitting diode or an inorganic light-emitting diode.

9. A lighting device, comprising a light-emitting assembly according to claim 1.

10. A display panel, comprising a plurality of pixel units, wherein each of the plurality of pixel units comprises at least one light-emitting assembly, each according to claim 1.

11. The display panel of claim 10, wherein in each of the plurality of pixel units, at least one light-emitting diode in each of the at least one light-emitting assembly is configured to emit a light of a different primary color from at least one alternative light-emitting diode, wherein:

lights from the light-emitting diode from each of the at least one light-emitting assembly are configured, once mixed with one another, to give rise to a white light.

12. The display panel of claim 11, wherein in each of the plurality of pixel units, each thermistor in each of the at least one light-emitting assembly is configured to adjust a brightness of the light emitted from its associated light-emitting diode such that the some light emitted from the light-emitting diode from each of the at least one light-emitting assembly is configured to give rise to a white light without a substantial deviation.

13. The display panel of claim 12, wherein:

each thermistor comprises at least one of a metal thermistor or a positive-temperature coefficient thermistor; and each thermistor is coupled to its associated light-emitting diode in series.

14. The display panel of claim 13, wherein in each of the plurality of pixel units, each of the at least one light-emitting assembly further comprises a driving transistor, wherein:

the thermistor comprises a metal thermistor;

a first electrode of the driving transistor is coupled in series to the thermistor; and a second electrode of the driving transistor is coupled in series to the light-emitting diode.

15. The display panel of claim 14, wherein:

the first electrode of the driving transistor is a source electrode of the driving transistor; and the second electrode of the driving transistor is a drain electrode of the driving transistor.

16. The display panel of claim 13, wherein each of the plurality of pixel units comprises a first light-emitting assembly, a second light-emitting assembly, and a third light-emitting assembly, wherein:

the first light-emitting assembly comprises a first thermistor, a first driving transistor, and a red light-emitting diode;

the second light-emitting assembly comprises a second thermistor, a second driving transistor, and a green light-emitting diode; and the third light-emitting assembly comprises a third thermistor, a third driving transistor, and a blue light-emitting diode;

wherein:

an electrical resistance of the first thermistor is higher than an electrical resistance of the second thermistor; and the electrical resistance of the second thermistor is higher than an electrical resistance of the third thermistor.

17. The display panel of claim 12, wherein:

each thermistor comprises a negative-temperature coefficient thermistor; and each thermistor is coupled to its associated light-emitting diode in parallel.

18. The display panel of claim 17, wherein in the each of the plurality of pixel units, each of the at least one light-emitting assembly further comprises a driving transistor, wherein:

two terminals of each thermistor are respectively coupled to an anode and a cathode of the light-emitting diode; and one electrode of the driving transistor is coupled in series to the light-emitting diode.

19. The display panel of claim 18, wherein the one electrode of the driving transistor is a drain electrode of the driving transistor.

20. The display panel of claim 17, wherein each of the plurality of pixel units comprises a first light-emitting assembly, a second light-emitting assembly, and a third light-emitting assembly, wherein:

the first light-emitting assembly comprises a first thermistor, a first driving transistor, and a red light-emitting diode;

the second light-emitting assembly comprises a second thermistor, a second driving transistor, and a green light-emitting diode; and the third light-emitting assembly comprises a third thermistor, a third driving transistor, and a blue light-emitting diode;

wherein:

an electrical resistance of the first thermistor is lower than an electrical resistance of the second thermistor; and the electrical resistance of the second thermistor is lower than an electrical resistance of the third thermistor.

* * * * *